US006554052B2

(12) United States Patent
Hashimian et al.

(10) Patent No.: US 6,554,052 B2
(45) Date of Patent: Apr. 29, 2003

(54) METHOD FOR PRODUCING HOLLOW JEWELRY RING DESIGN

(75) Inventors: Ervant Hashimian, Middle Village, NY (US); Garabed Ayvazian, Rego Park, NY (US)

(73) Assignee: Unimold Cast, Ltd., New York, NY (US)

( * ) Notice: Subject to any disclaimer, the term of this patent is extended or adjusted under 35 U.S.C. 154(b) by 0 days.

(21) Appl. No.: 10/237,218

(22) Filed: Sep. 9, 2002

(65) Prior Publication Data

US 2003/0000999 A1 Jan. 2, 2003

Related U.S. Application Data

(63) Continuation of application No. 09/606,644, filed on Jun. 29, 2000, now Pat. No. 6,453,699.

(51) Int. Cl.[7] ..... B22C 9/04
(52) U.S. Cl. ..... 164/35; 164/45; 164/516
(58) Field of Search ..... 164/34, 35, 516, 164/45, 235

(56) References Cited

U.S. PATENT DOCUMENTS 3,601,178 A * 8/1971 Marticorena ..... 164/45

* cited by examiner

*Primary Examiner*—Kuang Y. Lin
(74) *Attorney, Agent, or Firm*—Gottlieb, Rackman & Reisman, P.C.

(57) ABSTRACT

There is provided a method or process for fabricating a hollow jewelry article which is hollowed or bored out to an arcuate estent of 200° or greater. In accordance with this process, a metal ring model is prepared comprising a solid shank and a metal plate supported along the internal perimeter of the shank and arcuately extending at least 200° therealong. A first metal mold is produced from the metal ring model having the external shape of the jewelry article to be manufactured. From this mold, a wax model of the jewelry article is produced which is first filed down and then cast in order to form a metal model of a core insert; the core insert, like the ring model, has a plate disposed along the perimeter of the shank. This core insert is used to produce a second metal mold. This second mold may then be used repeatedly in order to form a soluble wax core insert model which is then inserted into the cavity of the first mold in order to define the hollow region of the article. A non-soluble wax is then introduced into the first mold for completely surrounding the soluble wax core insert. The non-soluble wax then hardens and the entire unit is removed from the first mold, including the soluble wax core. The core is then removed by a suitable water soluble or chemical mechanism. The remaining wax model contains a hollow core running along a substantial portion of the arcuate length thereof. The wax model is then cast in order to form the inventive ring design.

6 Claims, 7 Drawing Sheets

METHOD FOR PRODUCING HOLLOW JEWELRY RING DESIGN

This is a continuation of co-pending application Ser. No. 09/606,644 filed on Jun. 29, 2000, now U.S. Pat. No. 6,453,699.

BACKGROUND OF THE INVENTION

This invention relates to a method for casting or molding an article of jewelry, and more particularly, to a method for producing a bored out or hollow jewelry article such as a ring.

There are many well known processes used in the large volume production of jewelry. Such processes include die striking, casting and electroforming, all of which are used for producing metallic jewelry articles. Such production methods are capable of facilitating high volume, high speed production with very good reproducibility. For example, using permanent-mold casting or injection molding techniques, a single mold cavity may be used repeatedly to produce, at a low cost, a virtually unlimited number of jewelry articles of intricate detail and varying size.

In order to reduce production costs in the manufacture of jewelry articles, previous improvements have generally focused upon better equipment; very little effort has been directed to actually modifying the jewelry article that is produced in order to reduce the cost thereof. One way, of course, of reducing production costs is to reduce the amount of precious or semi-precious metal that is used in producing a jewelry article, while still achieving the visual presentation that is desired by the jewelry designer.

One such prior method involves the use of an acid or water-soluble wax insert disposed in a mold cavity in order to form a mold of a partially or completely hollow article. According to this technique, a soluble wax core insert is placed in a mold cavity. Then a molten wax is injected into the mold cavity, filling the cavity and surrounding the core insert. The core insert is then removed in order to produce a wax article having a hollow core.

In the prior art, the use of soluble wax core inserts has been less than desirable. In the first place, there have been difficulties in achieving proper alignment of the insert and in preventing random movement or shifting of the insert during waxing or casting. In addition, the prior art has failed to teach the use of a soluble wax core insert such that a hollow or bored out space is defined within the ring which extends virtually along the entire arcuate length thereof.

Moreover, in the prior art patent U.S. Pat. No. 5,718,278 to Baum, it is stated that it is not possible to produce a ring having an inner round radius design utilizing a vertically oriented mold configuration. However, the Baum process which utilizes a horizontally oriented mold configuration is less than desirable since it is not able to produce a ring which is hollowed or bored out to an arcuate content of 200° and up to or approaching 360°.

SUMMARY OF THE INVENTION

Generally speaking, in accordance with the invention, there is provided a method or process for fabricating a hollow jewelry article which is hollowed or bored out to an arcuate extent of 200° or greater. In accordance with this process, a metal ring model is prepared comprising a solid shank and a metal plate supported along the internal perimeter of the shank and arcuately extending at least 200° therealong. A first metal mold is produced from the metal ring model having the external shape of the jewelry article to be manufactured. From this mold, a wax model of the jewelry article is produced which is first filed down and then cast in order to form a metal model of a core insert; the core insert, like the ring model, has a plate disposed along the perimeter of the shank. This core insert is used to produce a second metal mold. This second mold may then be used repeatedly in order to form a soluble wax core insert model which is then inserted into the cavity of the first mold in order to define the hollow region of the article. A non-soluble wax is then introduced into the first mold for completely surrounding the soluble wax core insert. The non-soluble wax then hardens and the entire unit is removed from the first mold, including the soluble wax core. The core is then removed by a suitable water soluble or chemical mechanism. The remaining wax model contains a hollow core running along a substantial portion of the arcuate length thereof. The wax model is then cast in order to form the inventive ring design.

Because the ring model includes a plate supported along the internal perimeter of the shank, it is possible to produce a core insert which arcuately extends at 200° or greater, thereby enabling the production of a ring or other jewelry article which is bored out or hollowed within the shank thereof to an extent for greater than what is taught by the prior art.

It is therefore an object of the invention to produce a ring design having a shank which is hollowed to an arcuate extent of at least 200°.

Another object is to produce a ring design which uses less metal but still exhibits the same physical appearance.

Yet a further object of the invention is to produce a ring design in which the inside surface of the shank is substantially flat with rounded edges.

Still other objects and advantages of the invention will in part be obvious and will in part be apparent from the specification.

The invention accordingly comprises the several steps and the relation of one or more of such steps with respect to each of the others thereof, as well as an article of manufacture produced by carrying out these steps, and which possesses the features, properties and relation of elements, all of which will be exemplified in the process and article hereinafter disclosed and described, and the scope of the invention will be indicated in the claims.

DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENT

Figure 1:
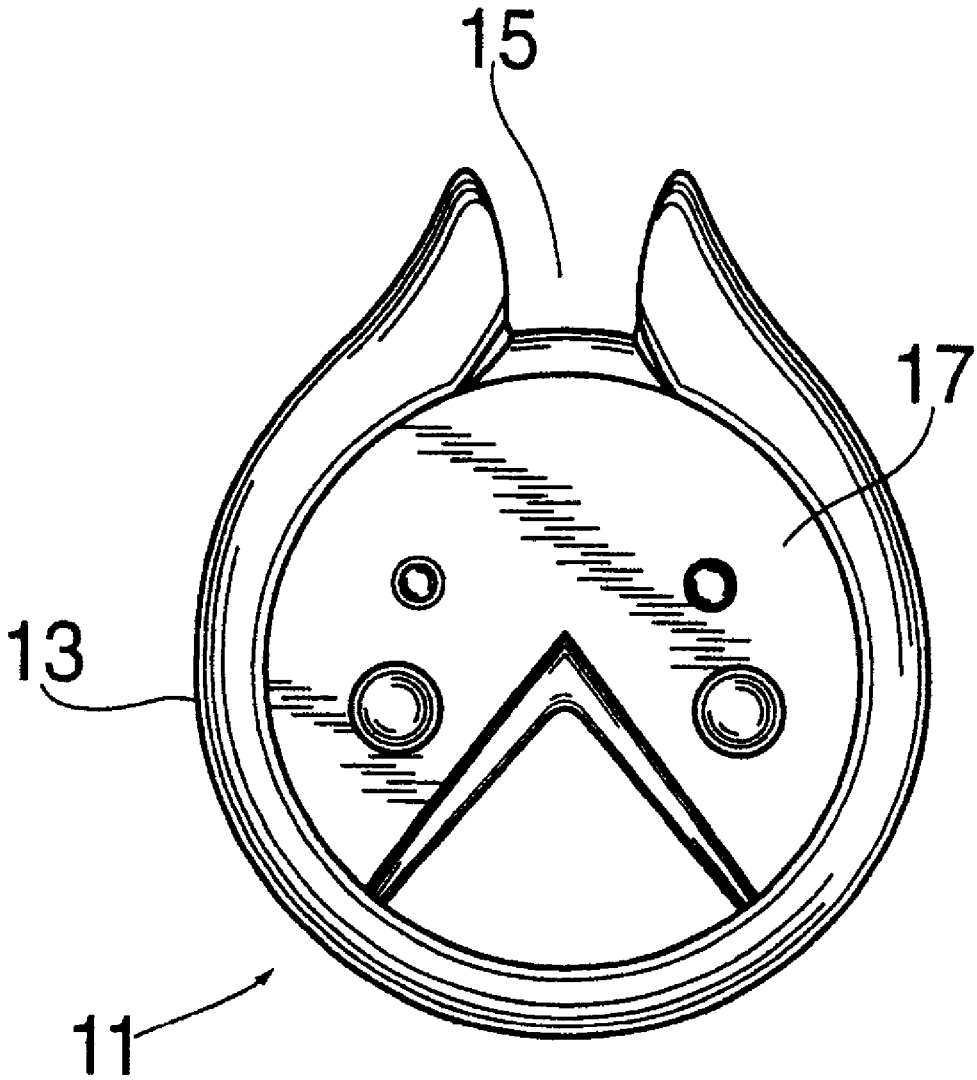
FIG. 1 is a front elevational view of a metal ring model and inside supporting plate that is used to produce the inventive jewelry ring.

Referring first to FIG. 1, a metal ring model which is used in producing a ring mold is generally indicated at 11. Metal ring model 11 consists of a shank 13, a setting portion 15 and an internally extending plate element 17 supported along the internal perimeter of shank 13. Metal ring model 11 has an external shape identical to the jewelry ring that is to be produced in accordance with the invention. Shank 13 preferably has a flat finger facing surface with rounded edges. Metal plate 17 is provided for enabling production of a core insert with a supporting plate and for thereby defining the extent to which the shank of the ring to be produced is hollowed or bored out, as described. Metal ring model 11 is used, as is well known in the art, to then prepare a vertically oriented mold thereof, as shown in FIGS. 2, 3 and 3A.

Figure 2:
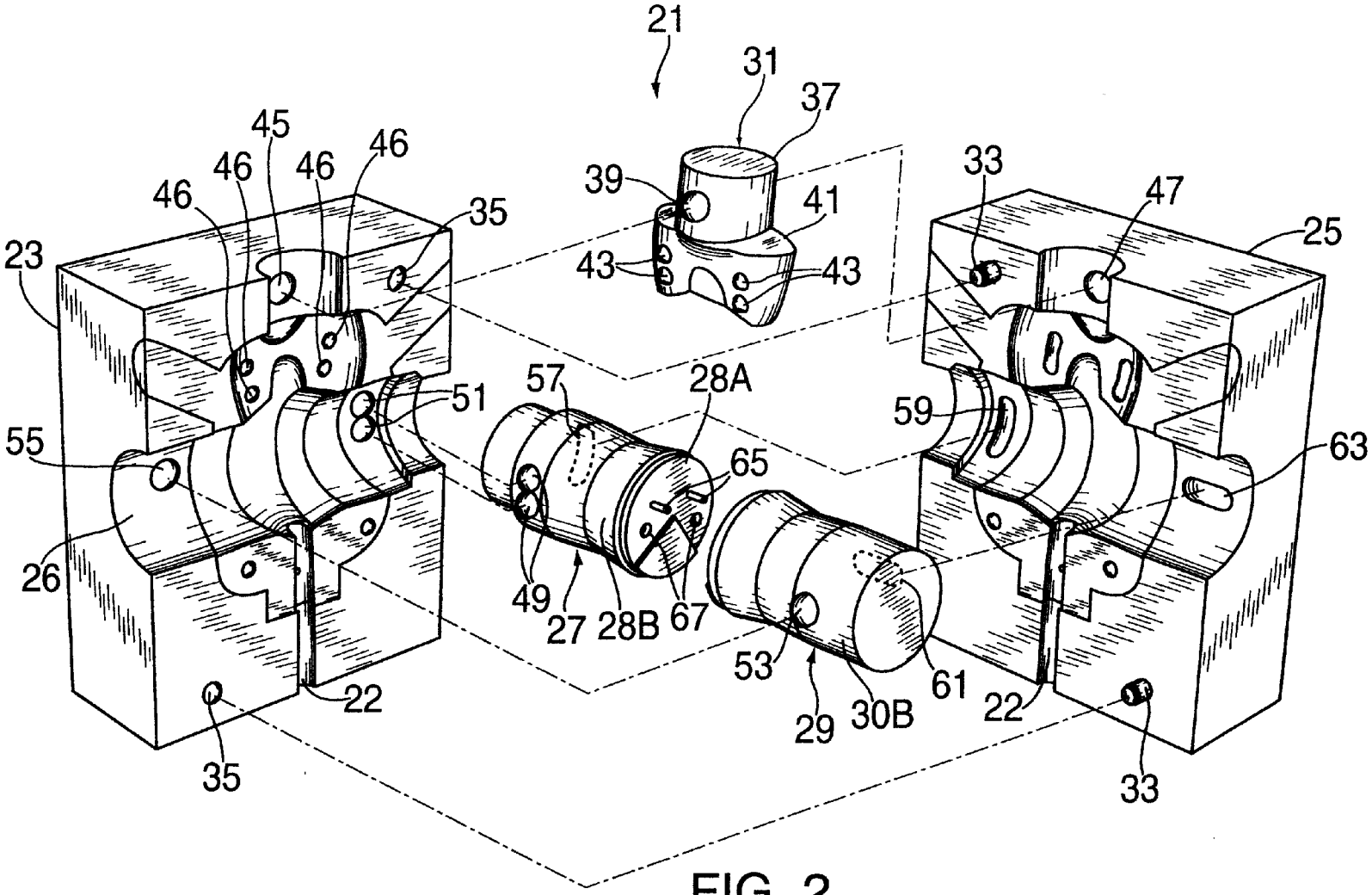
FIG. 2 is an exploded perspective view of two die elements, first and second side mold inserts and a crown mold insert, which together define a ring mold used in accordance with the present invention.
Figure 3A:
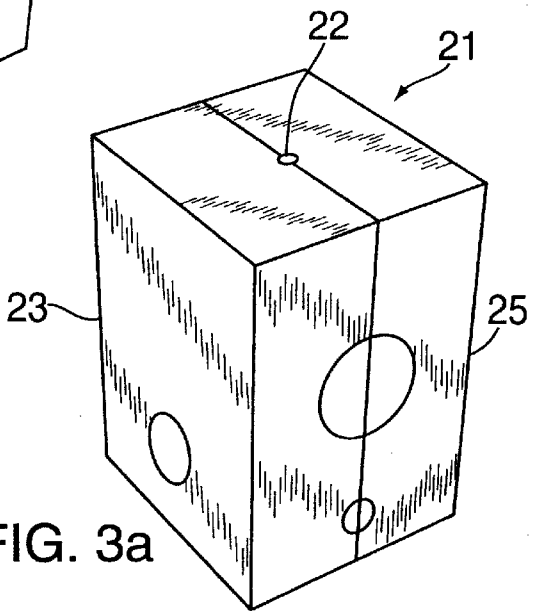
FIG. 3A is a bottom perspective view of the ring mold depicted in FIG. 2 in a fully assembled condition.
Figure 3:
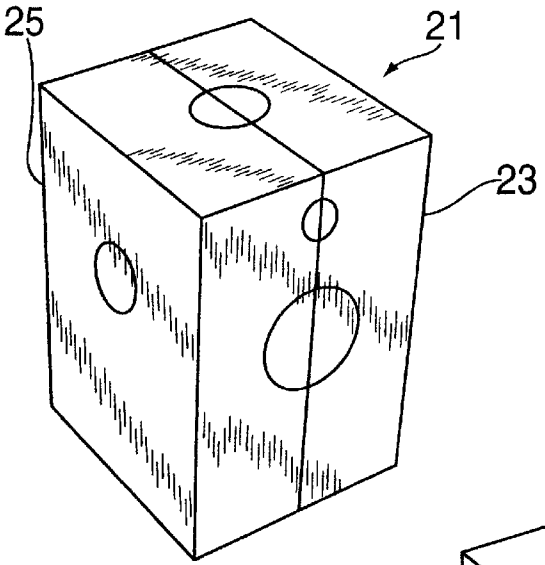
FIG. 3 is a top perspective view of the ring mold depicted in FIG. 2 in a fully assembled condition.

Referring now to FIGS. 2, 3 and 3A, a metal ring mold produced from metal ring model 11 depicted in FIG. 1 is generally indicated at 21. Ring mold 21 is vertically oriented and includes a pair of metal die elements 23 and 25, a pair of metal split side mold inserts 27 and 29, and a metal crown mold insert 31 in order to define, when assembled (see FIGS. 9 and 9A), a cavity that is shaped like metal ring model 11.

To facilitate proper alignment and assembly of die elements 23 and 25, locator pins 33 are provided along die element 25 for fitting into corresponding locator holes 35 formed along die element 23. Die elements 23 and 25 also define an inlet port 22 of mold 11 for injecting wax thereinto, as later described.

As shown in FIG. 2, crown mold insert 31 has a head portion 37 and a shoulder portion 41. Head portion 37 has a pair of locator plugs 39 (one is not shown) which are sized to be receivingly engaged within locator holes 45 and 47 respectively of die elements 23 and 25 in order to properly align crown mold insert 31 inside of mold 21. In addition, shoulder portion 41 includes a series of protuberances 43 on one side thereof for selective engagement within openings 46 formed along die element 23—this further facilitates proper fitting of crown mold insert 31 inside mold 21.

Each of side inserts 27 and 29 are cylindrically shaped and include inwardly directed top surfaces 28A and outside radial surfaces 28B and 30B. Top inside surface 28A of side insert 27 is formed with a pair of locator pins 65 and a pair of locator holes 67 for selectively and cooperatively engaging with corresponding holes and pins (not shown) formed along the top inside surface of side insert 29. Because of their design, side inserts 27 and 29, when mated together, define a space or cavity 26 (see FIG. 9A) of a configuration that is shaped like that of metal ring model 11. Radial surfaces 28B and 30B of mold inserts 27 and 29 are also formed with protuberances 49, 57 (for insert 27) and 53, 61 (for insert 29). These protuberances are selectively received in holes 51, 55 (of die element 23) and 59, 63 (of die element 25) in order to cooperatively retain inserts 27 and 29 in proper position within mold 21.

Figure 4:
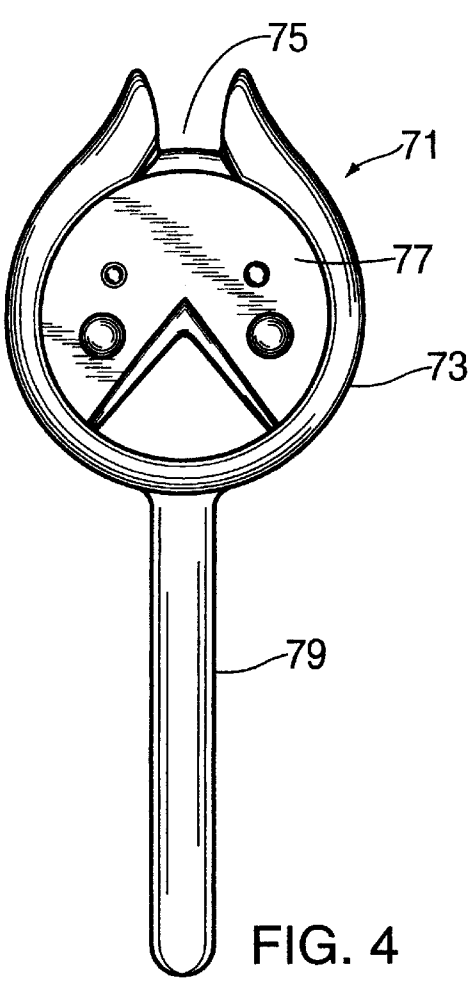
FIG. 4 is a front elevational view of a wax model of the ring that is produced utilizing the mold depicted in FIGS. 2, 3 and 3A.
Figure 6:
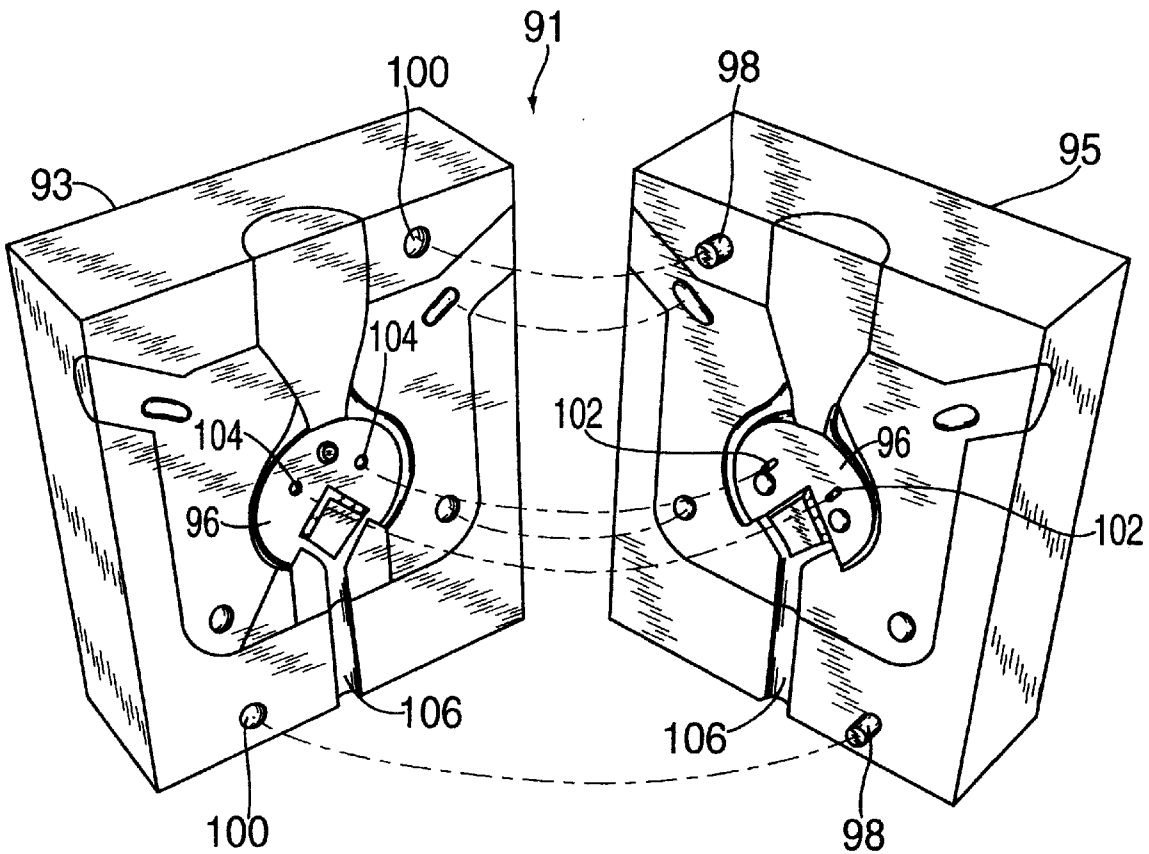
FIG. 6 is a an exploded perspective view of the two die elements of a second mold that is used to produce a wax model of the core insert.
Figure 5:
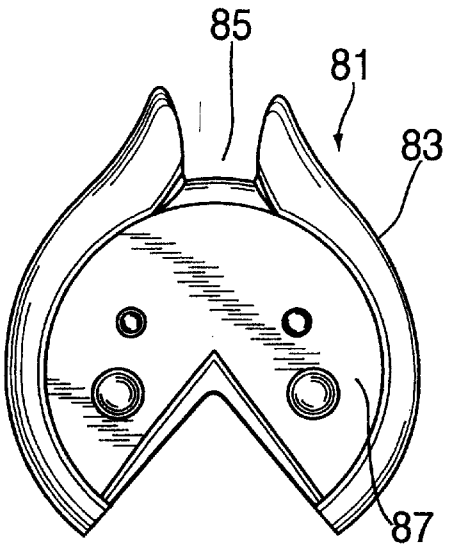
FIG. 5 is a front elevational view of a metal model of the core insert.
Figure 7:
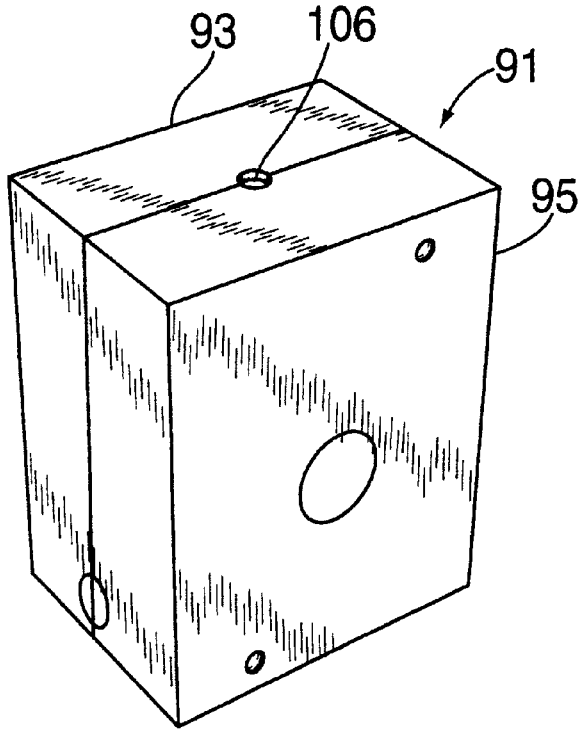
FIG. 7 is a bottom perspective view of the core insert mold depicted in FIG. 6 in assembled condition.

Once mold 21 is fully assembled, as shown in FIGS. 3 and 3A, wax is injected therein through inlet port 22 in order to produce a wax model 71 of the ring, as shown in FIG. 4. Wax model 71 includes a shank 73, a setting region 75 and an insert element 77 supported along the internal perimeter of shank 73; it also includes an extending sprew 79. After cutting off sprew 79, shank 73 of ring wax model 71 is filed down, after which model 71 is cast in order to produce a metal core insert model 81, as depicted in FIG. 5. Metal core insert model 81, like metal ring model 11 depicted in FIG. 1, includes a shank 83, a setting region 85 and a plate element 87 supported along the internal perimeter of shank 83. Significantly, metal core insert model 81 has a slightly smaller but nonetheless identical external shape to that of metal ring model 11. From metal insert model 81, using processes well known to one of ordinary skill in the art, a metal core insert mold, generally indicated at 91 and shown in FIGS. 6 and 7, is produced.

Figure 8:
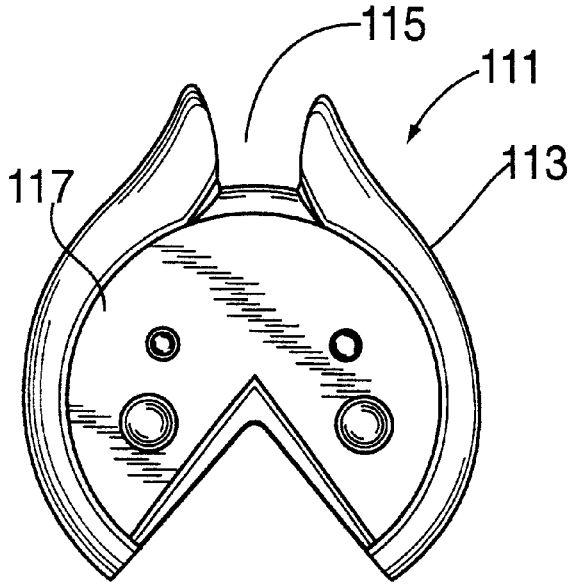
FIG. 8 is a front elevational view of a soluble wax model of the core insert that was produced utilizing the mold depicted in FIGS. 6 and 7.

Core insert mold 91, used to form a core insert, as described below, is of a somewhat similar construction to that of ring mold 11 and includes a first metal die element 93, and a second metal die element 95, which together when assembled define a core cavity 96. Die element 95 includes a pair of locator pins 98 which are designed to be matingly engaged with locator holes 100, as indicated in FIG. 6, in order to place mold 91 in a desired closed assembled condition, as shown in FIG. 7. Die element 93 further includes a pair of centrally disposed cavity locator pins 102 which are received in holes 104 formed along die element 93 in order to provide separation between die elements 93 and 95 and thus define cavity 96. Mold 91 is also provided with an inlet port 106 for injection of soluble wax into mold 91 in order to form a soluble wax model 111 of the core insert, as shown at 111 in FIG. 8.

Core insert wax model 111 is produced following injection of soluble wax through port 106 and into core insert mold 91. As can be appreciated, soluble wax model 111 has the same shape, but is slightly smaller than, the shape of ring wax model 71. Core insert wax model 111 includes a shank 113, a setting region 115, and an insert element 117 supported along the internal perimeter of shank 113.

Figure 9:
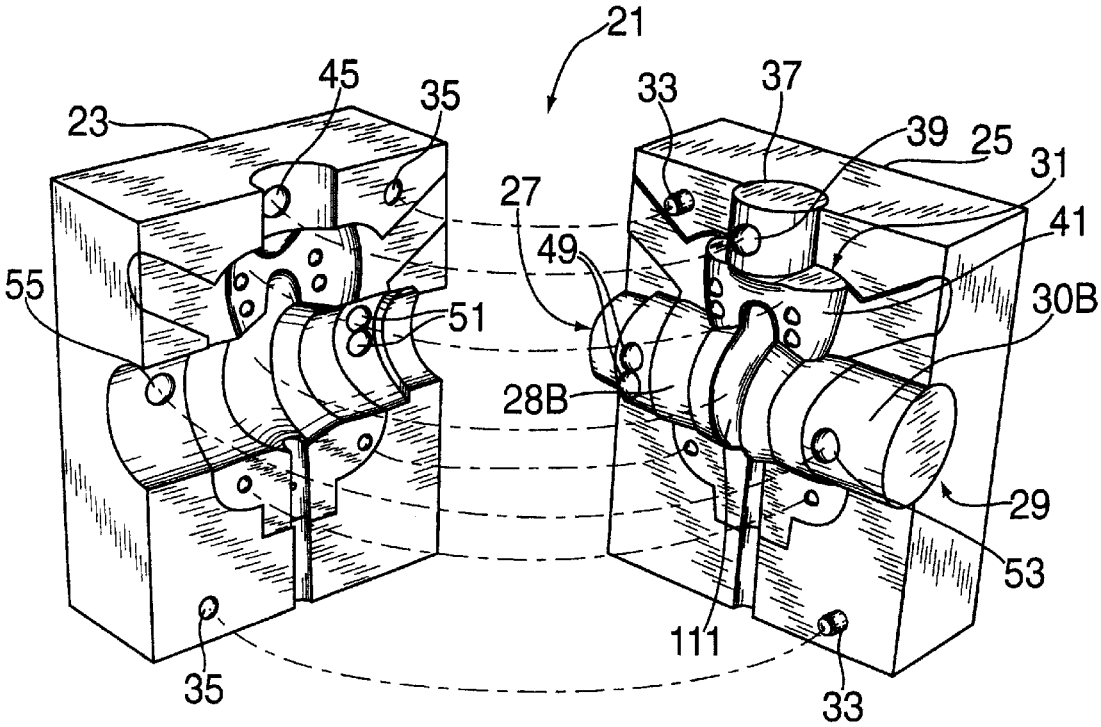
FIG. 9 is a partially exploded perspective view of the ring mold depicted in FIG. 2 in partially assembled condition with the soluble wax model of the core insert disposed between the two side mold inserts.
Figure 9A:
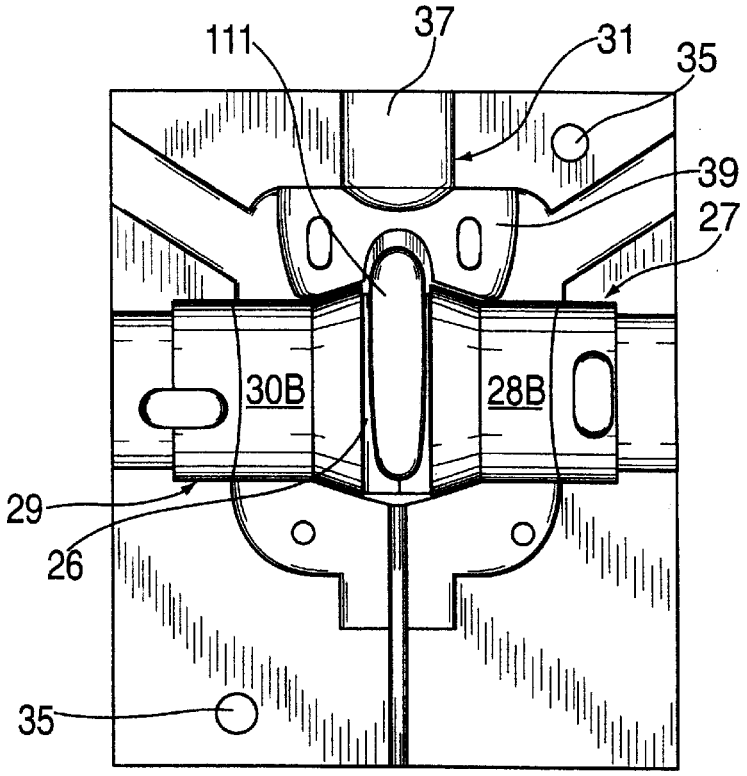
FIG. 9A is a front elevational view of one of the die elements of the ring mold and showing the soluble wax model of the core insert disposed between the two side mold inserts of the mold.

To fabricate the inventive ring (see FIGS. 11–12), core insert wax model 111 is placed inside ring mold 21, as shown in FIGS. 9 and 9A and positioned between first and second side mold inserts 27 and 29 and under crown mold insert 31. Because core insert wax model 111 is somewhat smaller in size than the ring to be produced, a gap is defined in cavity 26 and between first and second side mold inserts 27 and 29 and below crown mold insert 31 (see FIG. 9A). This gap defines the thickness of the shank wall of the final ring product, as discussed later. This gap is adjustable in size depending upon the extent to which the ring wax model is filed down in order to produce metal core insert model 81, as discussed before.

Figure 10:
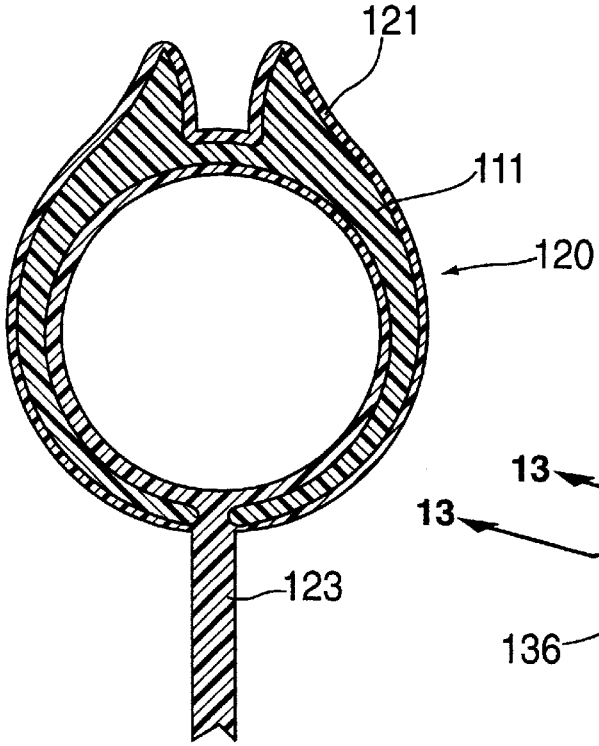
FIG. 10 is a cross-sectional view of the final plastic wax model that is produced utilizing the ring mold depicted in FIGS. 8 and 9 and showing both the soluble and non-soluble components thereof.

Once core insert wax model 111 is precisely positioned within ring mold 21, mold 21 is closed and a molten wax is introduced through port 22 and into ring mold 21, thereby filling the mold cavity and completely surrounding core insert wax model 111. After hardening, a wax article 120 is produced and then removed from mold cavity 26 in ring mold 21 with core insert wax model 111 intact. Wax model 111 is then eliminated from article 120 by applying a water soluble or another chemical mechanism, as is well known in the art, thereby leaving behind a non-soluble wax replica or component 121 of the inventive ring. FIG. 10 is most relevant here, since it illustrates both the non-soluble 121 and soluble 111 components which make up plastic article 120 that is produced at this stage in the process.

Figure 11:
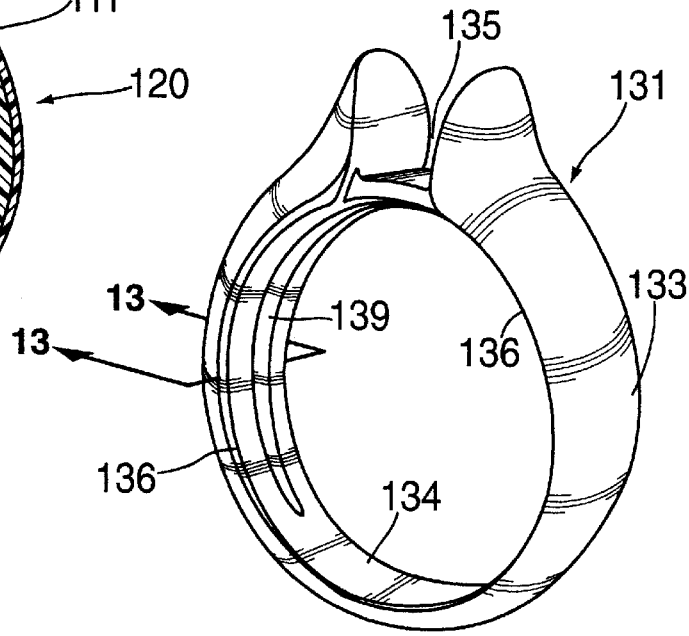
FIG. 11 is a perspective view of a finished ring made by casting the non-soluble portion of the final plastic model.
Figure 12:
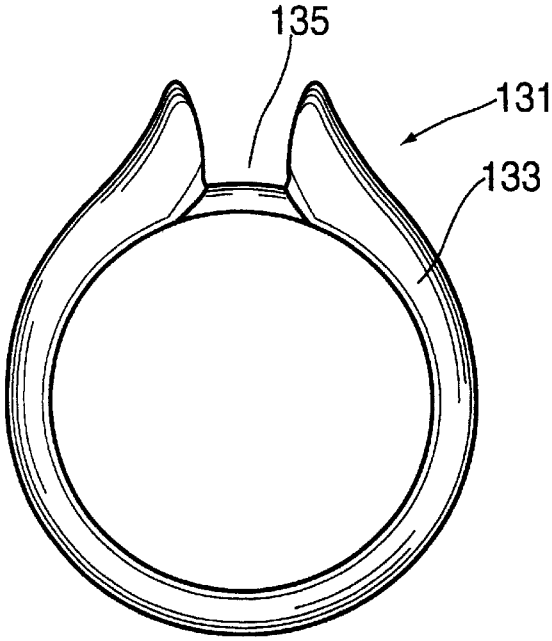
FIG. 12 is a side elevational view of the finished ring depicted in FIG. 11.
Figure 13:
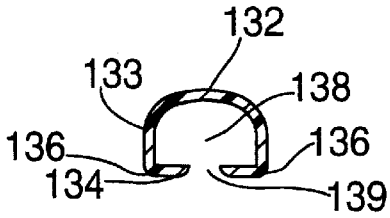
FIG. 13 is a cross-sectional view taken along line 13—13 of FIG. 11.

Non-soluble component 121 is used to produce a cast metal ring generally indicated at 131 in FIGS. 11 and 12. This is achieved by one of many well known methods known to those of skill in the art, such as the lost wax investment casting method. As can be appreciated, the final finished ring, as indicated at 131, includes a shank 133 defined by a wall 132 and setting portion 135. Ring 131 is formed with an arcuately extending opening 139 along a substantial portion of finger facing surface 134 of shank 133 leading to an internal arcuately running hollow cavity 138 (see FIG. 13). A small portion of finger facing surface 134 does not include opening 139, and may be used for jewelry stamping requirements or jewelry sizing needs, as is known. Significantly, in order to enhance comfort when wearing ring 131, shank 133 (see FIG. 13) has finger facing surface 134 being flat with slightly rounded edges 136.

In accordance with the invention, the arcuate range of cavity 138 of ring 131 obtainable under the current invention is on the order of 200° to 360°. This is because ring 131 is produced by first preparing a ring model having a plate supported along the internal perimeter of the shank, which enables production of a core insert that extends at least 200°. In contrast, prior art techniques can only attain an arcuate range of hollowness of no greater than 160°.

Importantly, wall 132 of shank 133 has a thickness of between 0.017 and 0.030 inch. The preferred thickness of wall 132 is 0.020–0.22 inch.

It will thus be seen that the objects set forth above, among those made apparent from the preceding description, are efficiently attained by practicing the invention and it is also understood the invention includes any and all changes or modifications thereto which would be apparent to one of ordinary skill in the art and which come within the spirit and scope of the inventive concept.

What is claimed is:

1. A method of producing a hollow metal jewelry ring comprising the steps of:

providing a mold with a vertically oriented mold cavity and having a shape consistent with an external shape of the ring to be produced;

providing a core insert having an arcuate extent of between 200° and 360° as well as being formed of a soluble material and having a shape consistent with but slightly smaller than the ring to be produced;

vertically positioning the core insert in the mold cavity of said mold;

introducing a molten material into said vertically oriented mold cavity in order to surround the vertically oriented core insert and thereby fill said mold cavity;

hardening the molten material in order to form a reproduction of the ring to be produced;

removing the ring reproduction from the mold cavity;

separating the core insert from the reproduction in order to leave behind an arcuate hollow cavity within the ring reproduction; and casting said hollow metal jewelry ring by utilizing the reproduction.

2. The method of claim 1, wherein said core insert includes an internal plate for defining said arcuate extent.

3. The method of claim 1, wherein said core insert is made of a soluble wax or other soluble material.

4. The method of claim 1, wherein said mold comprises a pair of die formed in a vertical arrangement.

5. The method of claim 4, wherein said mold further includes a pair of split side mold inserts.

6. The method of claim 4, wherein said die are formed of metal.

* * * * *